United States Patent [19]

George

[11] 3,997,160

[45] Dec. 14, 1976

[54] FOOTBALL TRAINING AID

[76] Inventor: Edward G. George, 17 Maughan Road, Baie d'Urfé, Quebec, Canada

[22] Filed: Mar. 17, 1975

[21] Appl. No.: 558,628

[52] U.S. Cl. ..... 273/55 R; 272/136; 272/140; 272/141

[51] Int. Cl.[2] ..... A63B 67/00

[58] Field of Search ..... 273/55 R, 55 A, 204; 272/79 R, 79 C, 76, 77, 78; 73/379, 380, 381

[56] References Cited

UNITED STATES PATENTS

| | | | |
|---|---|---|---|
| 1,839,040 | 12/1931 | McCarrier | 273/204 |
| 2,074,125 | 3/1937 | Lefft et al. | 273/55 R |
| 2,255,711 | 9/1941 | Noor | 273/55 R |
| 2,440,577 | 4/1948 | Denby | 273/55 R |
| 3,637,210 | 1/1972 | Brantley | 273/55 R |
| 3,674,265 | 7/1972 | Sheets | 273/55 R |

*Primary Examiner*—Richard C. Pinkham
*Assistant Examiner*—T. Brown
*Attorney, Agent, or Firm*—Alan Swabey & Co.

[57] ABSTRACT

A football training aid in which there is an elongated horizontal track, a carriage adapted to move in the track along a predetermined distance and being biased against movement in at least one direction, an upstanding member mounted on the carriage, a padded dummy mounted on the upstanding member to thereby apply reactive pressure against the rush of a football player in the biased direction. More specifically, the dummy can be thrown to either side and be twisted about a vertical axis.

10 Claims, 7 Drawing Figures

FOOTBALL TRAINING AID

BACKGROUND OF THE INVENTION

1. Field of the Invention

The present invention relates to an athletic training device, and particularly to a training aid for developing certain skills in football players.

2. Description of the Prior Art

A defensive lineman must be able to rush an offensive lineman and push the offensive lineman directly backwards or to make his move and throw the offensive lineman either to the left or to the right and to continue his onward rush. As a training aid for an offensive lineman, on the other hand, it is necessary that the lineman apply a standing block to the defensive lineman and continue to keep the defensive lineman engaged and to actually back him up for approximately 5 yards.

Many training aids have been developed which are useful in training offensive linemen since basically they all include a padded dummy body which is spring loaded or hydraulically mounted on a frame or sled and is adapted to retract under the pressure of the onward block. Examples of such devices can be seen in U.S. Pat. Nos. 3,514,105, Pillard, 1970; 3,578,324, Alvey et al, 1971; 3,365,947, Janich III et al, 1968; 3,329,428, Moran, 1967; and 2,390,336, Spearman, 1945. However, all of these devices have an upstanding frame directly behind the padded dummy which prohibits a defensive lineman from fully exercising his rush, that is, in deflecting or throwing the dummy and continuing past the dummy. Furthermore, since the frame structure of the patents mentioned above is adapted to receive the full horizontal force of the block, it is easily slidable on the surface on which it might be standing. Accordingly, as shown in these patents, it is required to anchor the frame solidly to the surface on which the frame may be standing. In the case of the Moran patent, however, the frame is allowed to slide on skids since the Moran device is an actual sled, and the weight of the sled is used to counteract the block. Such devices would hardly be useful on a gymnasium floor unless special provisions are made for anchoring the frame.

SUMMARY OF THE INVENTION

It is an aim of the present invention, therefore, to provide a training aid which is useful to both offensive lineman and defensive lineman. It is a further aim of the present invention to provide a simple structure as a training aid which can be set up inside in a gymnasium, for instance, or outside on a training field. It is a further aim of the present invention to provide a training aid mounting a padded dummy which more closely simulates an actual opposing football player. It is still a further aim of the present invention to provide an upstanding dummy with no obtrusive framework behind the dummy to thereby allow a defensive lineman to continue his rush after pushing and deflecting the dummy.

A construction in accordance with the present invention includes an elongated horizontal track housing, a carriage adapted to move a predetermined distance in said track housing, an upstanding member mounted on said carriage, an impact imparting and receiving means mounted to said upstanding member, and said carriage being biased against movement in at least one direction within said track housing to thereby apply reactive pressure against the rush of the user in said direction.

A more specific aspect of the present invention includes said carriage and said upstanding member being resiliently pivotably mounted to said carriage for pivoting movement in a plane transverse to the direction of movement of said carriage in said track housing.

In a more specific aspect of the present invention, the impact imparting and receiving member includes a shell simulating the upper body of a football player, a shaft member mounted on the upright stem, said shell member being journaled to the shaft member for limited rotational movement thereon and biasing means biasing the limited rotational movement of the shell to the shaft.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
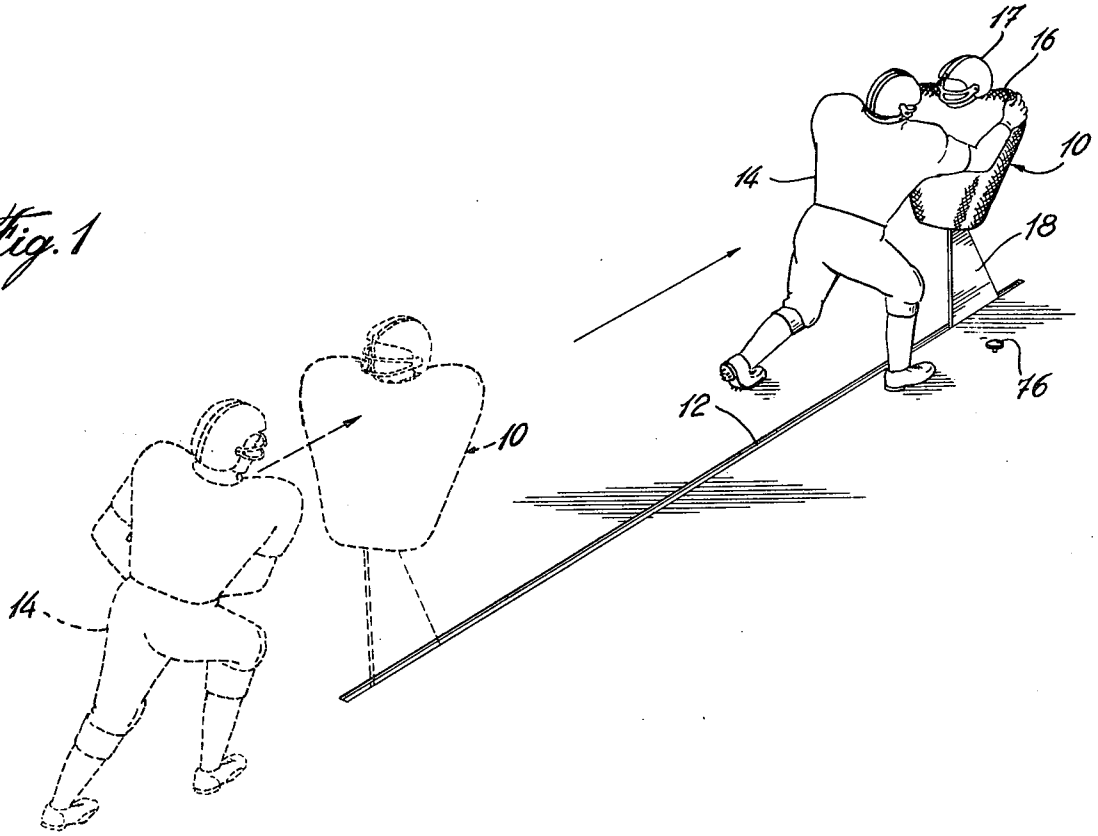
FIG. 1 is a perspective view of a typical embodiment of the present invention showing a football player in dotted lines approaching the padded dummy also shown in dotted lines in the fully locked position after the football player has blocked the dummy.

Referring now to the drawings, and especially FIGS. 1 to 5, there is shown a dummy 10 which travels along a predetermined path defined in FIG. 1 by the slot 12. The dummy 10 can be engaged by a typical football player 14 as shown in FIG. 1. The dummy 10 includes a base portion 18 and an upper padded shell 16 which is meant to closely simulate the shape of an opposing lineman with pads and helmet 17. A sweater could also be placed on the upper portion of the dummy in order to increase the visual simulation.

Figure 2:
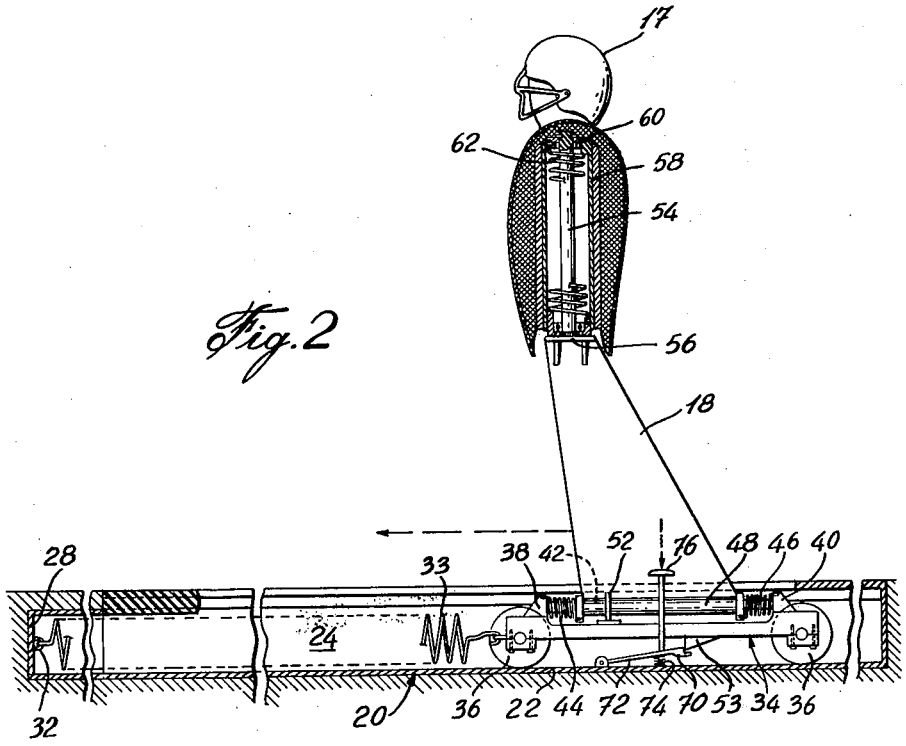
FIG. 2 is a vertical cross-sectional view taken through the device of FIG. 1.
Figure 4:
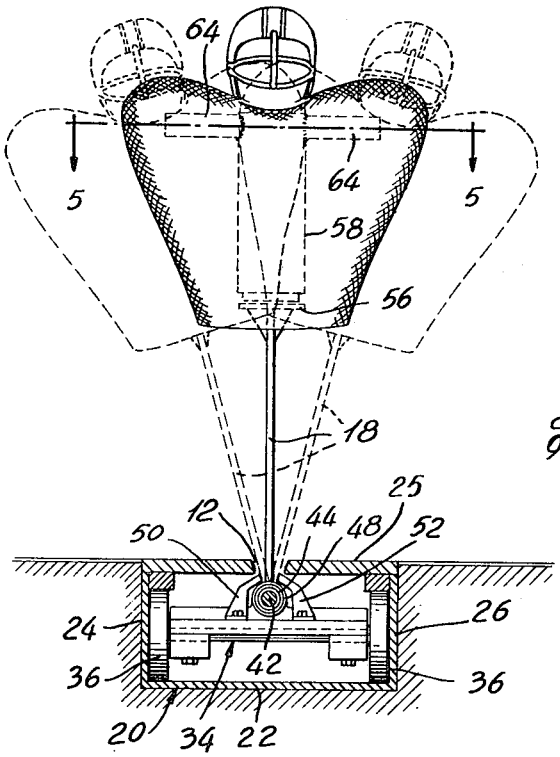
FIG. 4 is a front elevation, partly in cross-section, of the apparatus shown in FIG. 1.
Figure 5:
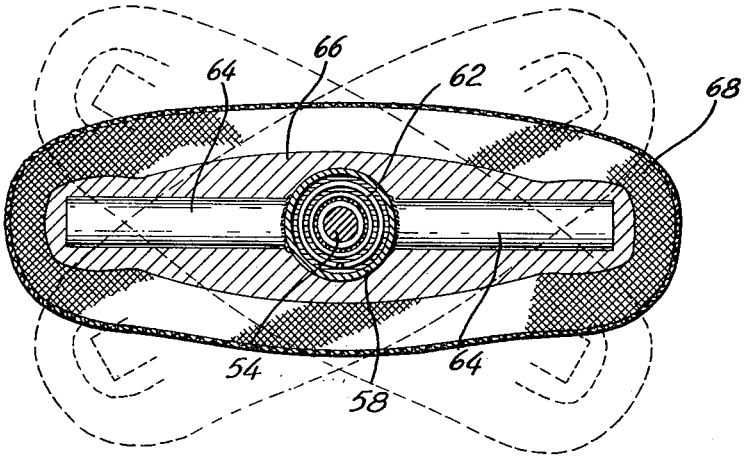
FIG. 5 is a horizontal cross-section taken along the line 5—5 of FIG. 4.

FIGS. 2 and 4 illustrate the structure of the track housing 20. The track housing includes a bottom wall 22, side walls 24 and 26, and a top wall 25. The top wall 25 would have the elongated slot 12 which is evident in FIG. 1. The housing 20 also includes end walls 28 and 30, and end wall 28 mounts an anchor ring 32. A carriage 34 is mounted for movement within the housing 20. The carriage 34 is biased for movement by means of a tension spring 33 which is anchored at one end to the anchor ring 32 at end wall 28.

Figure 3:
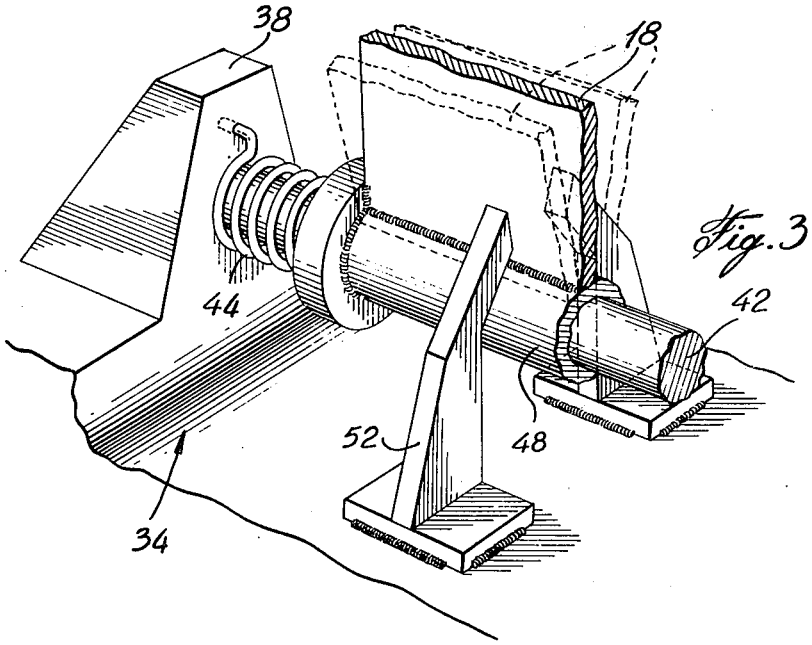
FIG. 3 is an enlarged fragmentary perspective view of a detail of FIG. 2.

The carriage 34 includes wheels 36 and a pair of journal brackets 38 and 40. A shaft 42 extends between the brackets 38 and 40, while a sleeve 48 is journaled on the shaft 42. Torsion springs 44 and 46 are located on the shaft 42 on either end of the sleeve 48 and are fixed to the brackets 38 and 40 respectively. The other ends of the springs 44 and 46 are also fixed at each end of the sleeve 48. The base 18 of the dummy is, of course, fixed to the sleeve 48. The base 18 may be of plate steel as shown in the drawings and is preferably angled forward as shown in FIG. 2. Stoppers 50 and 52, as shown in FIGS. 3 and 4, are also provided to limit the lateral pivoting movement of the base 18 within an angle of about 15° on either side of the vertical plane and would normally be less.

A horizontal anchor plate 56 is mounted at the top of the base 18 and is braced thereto. An upstanding shaft 54 is fixed to the base 56, and the shell 16 is mounted thereover and includes a sleeve 58 fixed to an annular bearing ring 60 which is adapted to rotate relative to the shaft 54. A torsion spring 62 is provided within the confines of the sleeve 58 and is fixed at one end to the base plate 56 and at the other end to the bearing ring 60. This arrangement allows for rotational movement on the shell 16 about a vertical axis.

Preferably, the slot 12 in the housing 20 will be about 6 yards in length. The final yard distance that the carriage can travel will include a latched device 70 adapted to engage a catch seat 53 on the carriage. If the football player can move the dummy 10 a distance greater than 5 yards against the spring 33, the catch 53 will engage the latch 70 against the spring 74, and the carriage will be locked in a final position. In order to have the carriage returned to its initial position, a lever or pedestal 76 can be depressed in order to disengage the latch 70 from the catch seat 53.

Figure 7:
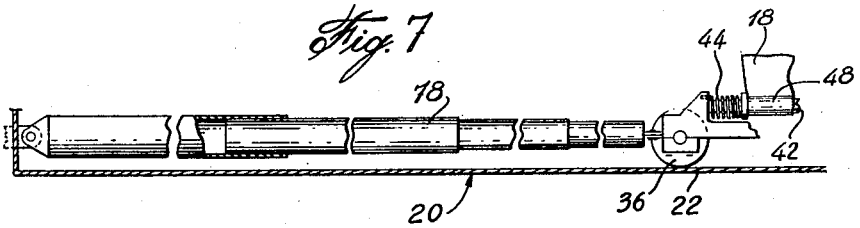
FIG. 7 is a fragmentary side elevation of a detail of a further embodiment of the present invention.
Figure 6:
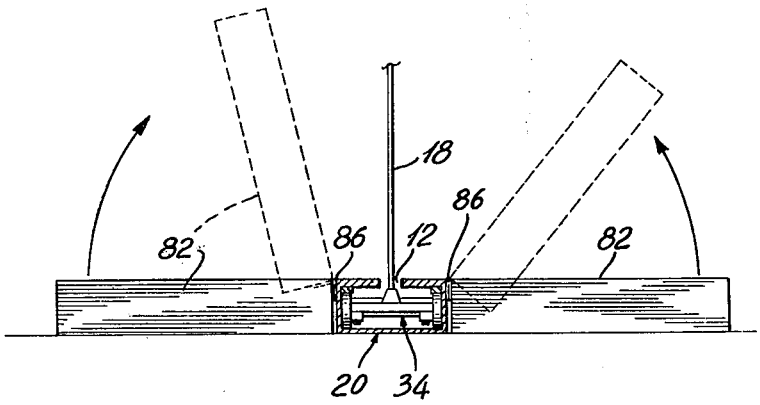
FIG. 6 is fragmentary front elevation, partly in cross-section, of an embodiment of the present invention.

The housing 20 could be portable and be made from a plurality of modular sections. It could have a configuration as shown in FIG. 6 where side platforms would be hinged to the side walls of the housing 20 in order to give an elevated platform around the housing 20 to allow the player to run safely against the dummy. The embodiment of FIG. 6 would be best suited for a portable training device. Of course, the hinged platforms 82, hinged at 86 on the housing 20, as shown in FIG. 6, could be used out on the training field or within a gymnasium and then be folded up when not in use. The housing could, of course, be permanently laid at a location on an outdoor field, and the housing could be made out of set concrete or the like. Furthermore, instead of the spring 33, a telescopic hydraulic boom 78, as shown in FIG. 7, could be provided. Advantages could be obtained using the hydraulic boom in that a coach or other person could vary hydraulically the resistance of the dummy or carriage to the force being applied thereon. Also, a known hydraulic meter could be used to determined the amount of force exerted by the football player against the apparatus.

In operation, it is necessary to train an offensive lineman; then it is merely necessary for the lineman 14 to initiate his charge at a position in front of the dummy 10 when it is in dotted lines as shown in FIG. 1. The lineman can lunge at the dummy 10 and continue his charge for a distance of 5 yards which is considered a necessary distance for moving a defensive lineman out of action. Once the lineman 14 has moved the dummy 10 to the position shown in FIG. 1 in full lines, that is, a distance more than 5 yards, the catch seat 53 will have engaged the latch 70 as described above. The lineman can then disengage himself from his blocked position on the dummy 10 at leisure. It is also evident that once the lineman would have moved the dummy 10 to a position shown in full lines in FIG. 1 and the catch would have engaged the latch 70, then he has accomplished what he has set out to do. The coach or the player can then disengage the latch 70 by depressing the pedestal 76.

If the training aid is being used for training a defensive lineman, the skills required are slightly different. As is well known, a defensive lineman must pass the offensive lineman and put him out of action simultaneously as he rushes towards the ball carrier or quarterback. Accordingly, not only should the defensive lineman charge at the offensive lineman and press him back, but he should also be able to twist and throw him to either side and continue his course. Accordingly, the lineman 14 can deflect the shell 16 about a vertical axis and at the same time pivot the dummy 10 about the horizontal axis of a shaft 42, against the force of the springs 62 and 44 and 46 respectively.

I claim:

1. A football training aid comprising an elongated, hollow horizontal housing comprising a track adapted to be located on a supporting surface, a carriage adapted to move a predetermined distance in said housing, an upstanding member mounted on said carriage; an impact-receiving means mounted on the upstanding member, said carriage being biased against movement in one direction along the track to thereby apply reactive pressure against the rush of the user in said direction, the carriage including an elongated bearing shaft extending in the direction of travel of said carriage, the upstanding member including a sleeve journaled on said bearing shaft for lateral pivotal movement about the longitudinal axis of the bearing shaft; and torsion spring means biasingly connected to said sleeve for biasing the lateral pivoting movement of said upstanding member.

2. A training aid as defined in claim 1, wherein means are provided for limiting the lateral pivoting movement of said upstanding member.

3. A training aid as defined in claim 1, wherein the carriage includes an elongated body including wheels at each end of said body for rolling movement within said housing, and a tension spring provides a biasing movement in said one direction, said tension spring being attached to an end wall of the housing.

4. An apparatus as defined in claim 1, wherein said carriage is attached to one end of a hydraulic telescopic boom and the other end of the hydraulic telescopic boom is attached to said end of one housing.

5. An apparatus as defined in claim 1, wherein said housing includes an elongated slot through which the upstanding member extends and the length of the housing is at least 6 yards, and there being provided a locking means for locking said carriage after a user has moved said carriage about 5 yards.

6. An apparatus as defined in claim 1, in which said housing is in the form of an elongated box member with a median slot extending along a top section thereof, and platform means are hinged to either side and end of the housing.

7. An apparatus as defined in claim 1, wherein the top of the upstanding member includes a shaft fixed to said upstanding member, a shell including a cylindrical sleeve member concentric with said shaft and bearing thereon, a torsion spring member within said cylindrical sleeve fixed to said sleeve and to the upstanding member to provide biased rotational movement of said shell member relative to the upstanding member.

8. An apparatus as defined in claim 7, wherein said shell is provided with padding simulating the configuration of the upper body of an equipped football player.

9. An apparatus as defined in claim 1, wherein said shaft and said sleeve are cylindrical and concentric, and stop means are provided for limiting said pivotal movement of said upstanding member.

10. A football training aid comprising an elongated, hollow horizontal housing comprising a track adapted to be located on a supporting surface, a carriage adapted to move a predetermined distance in said housing, an upstanding member mounted on said carriage, said carriage being biased against movement in one direction along said track to thereby apply reactive pressure against the rush of a user in that direction, said upstanding member including a shaft fixed thereto, a shell including a sleeve concentric with said shaft and bearing thereon, torsion spring means within said sleeve fixed to said sleeve and to the upstanding member to provide biased rotational movement of said shell relative to said upstanding member.

* * * * *